United States Patent [19]

Keivanjah

[11] Patent Number: 4,642,056

[45] Date of Patent: Feb. 10, 1987

[54] RECREATIONAL WATER CRAFT

[76] Inventor: Massoud Keivanjah, 1380 Lakewood Dr., Lexington, Ky. 40502

[21] Appl. No.: 738,398

[22] Filed: May 28, 1985

[51] Int. Cl.[4] ..... B63H 16/04

[52] U.S. Cl. ..... 440/15; 440/14; 416/66

[58] Field of Search ..... 440/14, 15, 101, 102, 440/92, 93; 114/283, 345, 69; 416/64–66, 81, 83; 244/11, 22, 72

[56] References Cited

U.S. PATENT DOCUMENTS

| | | | |
|---|---|---|---|
| 227,491 | 5/1980 | Coulter | 440/15 |
| 515,883 | 3/1894 | Pelletier | 440/92 |
| 2,156,898 | 5/1939 | Lo Giudice | 440/14 |
| 3,622,437 | 11/1971 | Hobaica | 114/69 |
| 3,694,836 | 10/1972 | Serra | 114/345 |
| 3,834,343 | 9/1974 | Hopkins | 440/14 |
| 3,880,107 | 4/1975 | Miles | 440/14 |
| 3,954,084 | 5/1976 | Cronin | 440/92 |
| 4,172,427 | 10/1979 | Kindred | 440/15 |
| 4,345,903 | 8/1986 | Laser | 440/14 |
| 4,353,321 | 10/1982 | Liu | 114/283 |
| 4,389,195 | 6/1983 | Sohaei | 440/15 |

FOREIGN PATENT DOCUMENTS

| | | | |
|---|---|---|---|
| 1650772 | 7/1967 | Fed. Rep. of Germany | 416/83 |

*Primary Examiner*—Trygve M. Blix
*Assistant Examiner*—C. T. Bartz
*Attorney, Agent, or Firm*—King and Schickli

[57] ABSTRACT

A water craft includes a pair of spaced buoyant panels mounted to a substantially H-shaped frame. A pair of fins mounted along a central longitudinal member of the frame between the panels provides propulsion and steering control. Propulsion is maximized by means of a combined cam, linkage and telescoping support structure that varies the length of the aft fin so as to oscillate the fin in a substantially figure eight path. Further, the rigidity and flexibility of the fin may be controlled through a tension cable and hand actuator.

16 Claims, 9 Drawing Figures

RECREATIONAL WATER CRAFT

TECHNICAL FIELD

The present invention relates generally to rider propelled water craft for recreation and sport. More particularly, the new water craft utilizes a fin propulsion system of improved efficiency.

BACKGROUND OF THE INVENTION

It is well known in the art to propel and steer small water craft with the muscular effort of the rider utilizing paddles, oars, oscillating fins and the like. Specific examples of craft having such propulsion devices include U.S. Pat. No. 227,491 to Coulter; U.S. Pat. No. 4,172,427 to Kindred; and U.S. Pat. No. 4,389,195 to Sohaei.

Of these, both Coulter and Kindred disclose water craft powered by oscillating fins formed of flexible material. During lateral oscillation, a flexible fin bends due to water resistance. The resulting curvature change redirects the driving force produced by the fin from a sideward to a substantially backward direction. Consequently, the driving force is better directed for pushing the craft forward through the water and propulsion efficiency is increased.

While these devices are effective, greater efficiency is, however, still possible. This increased efficiency is best realized by studying and more closely imitating the actual swimming motion of a fish. The fish adjusts the curvature of its caudal fin in accordance with the fins angular position along its arc of movement as well as the fins speed of lateral oscillation. By doing this, the fish assures that the driving force produced by the fin is directed as nearly as possible straight backward in relation to its body for maximum propulsion efficiency at all times.

It should also be recognized that the caudal fin is not simply oscillated by the fish back and forth along a constant arc. Rather, the fin is moved in a substantially figure eight path. For creating such a undulatory propulsion, the fish (having the fore part of its body against the water to resist lateral motion) generates a wave by the transverse motion of the rear body segments. This wave passes down the body and results in the caudal fin taking up a substantially figure eight path during its lateral oscillation. Such motion of the fin not only exerts a push against the water from side to backward direction, but also slips away from the wake created during making up the curved part of the path. Advantageously, this reduces drag for still greater efficiency while also positioning the fin in a contracted position from which to push backward and outward against the water during the next power portion of the swimming cycle.

Additionally, it should be recognized that the front portion or primary body of the fish acts as a counterbalance to the natural lever arm of the rear fin. Water resistance along the sides of the body prevent lateral drift and twisting of the fish from side-to-side about the desired line of travel during fin oscillation. Thus, the pivot point of the rear fin is held fixed along the desired line of travel and the working power is efficiently transferred from one end of the fin to the other. No energy is lost to rocking movement and maximum propulsion efficiency is obtained.

If this natural fish action could be mechanically imitated for the greater propulsion efficiency and a watercraft designed to incorporate it, a significant step forward in the art could be made. Such a watercraft would be particularly appealing as an entry in the self-propelled watercraft field.

SUMMARY OF THE INVENTION

Accordingly, a primary object of the present invention is to provide a rider propelled watercraft with improved overall propulsion efficiency.

A more specific object of the present invention is to provide a water craft with a propulsion system more closely imitating that of a fish so as to benefit from increases in efficiency.

Another object of the present invention is to provide a new and useful water craft that is both fun and easy to operate.

Additional objects, advantages, and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects and in accordance with the purposes of the present invention as described herein, an improved rider propelled water craft is provided for sport and recreation that is simple to operate. The water craft includes a substantially H-shaped tubular frame made from a suitable lightweight plastic, such as polyvinylchloride. Balance and flotation are provided through a pair of buoyant panels or pontoons that are streamlined for smooth cutting action through the water. The polyvinylchloride tubes of the frame may also be sealed for additional flotation. One panel is connected to each side of the frame spaced equidistant from a central longitudinal frame member. A pair of aligned fins are provided along the central longitudinal frame member for moving and steering the craft. Additionally, means are provided for varying the length of at least one of these fins during lateral oscillation so as to increase the driving force of the fin to the craft for improved propulsion efficiency.

Preferably, the rear fin of the craft is mounted to a telescoping support. The telescoping support is formed from a pair of concentrically disposed tubes in sliding engagement. Each tube includes a substantially elliptical cross-section to prevent relative radial orientation changes between the tubes and, therefore, prevent twisting of the rear fin. The linkage connects the telescoping tube directly supporting the rear fin to the central longitudinal frame member. A cam actuator, including a pair of adjacent cam plates, contacts the linkage to provide the relative telescopic movement to the support. Thus, as the fin moves from one side of the oscillation path to the other, the telescopic support or lever arm of the fin is increased for additional forward thrust. As the fin continues to move and is readied for oscillation in the reverse direction, the telescoping tube member supporting the fin is retracted. Thus, the lever arm of the fin is reduced in length and the fin slips from the wake created during the power portion of the propulsion cycle thereby decreasing drag.

Propulsion efficiency and overall control of the craft is further regulated by the rider through the provision of a hand actuator and tension cable for selectively controlling the flexibility and rigidity of the rear fin. In other words, this control allows the rider to adjust the flexibility and rigidity of the fin manually, and this may be coordinated in relation to its speed of oscillation. Automatic adjustment relative to the angular position of the fin is also advantageously provided. In either mode or operation, the desired end result is increased power and driving efficiency.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regrded as illustrative in nature and not as restrictive.

BRIEF DESCRIPTION OF THE DRAWING

The accompanying drawing incorporated in and forming part of this specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
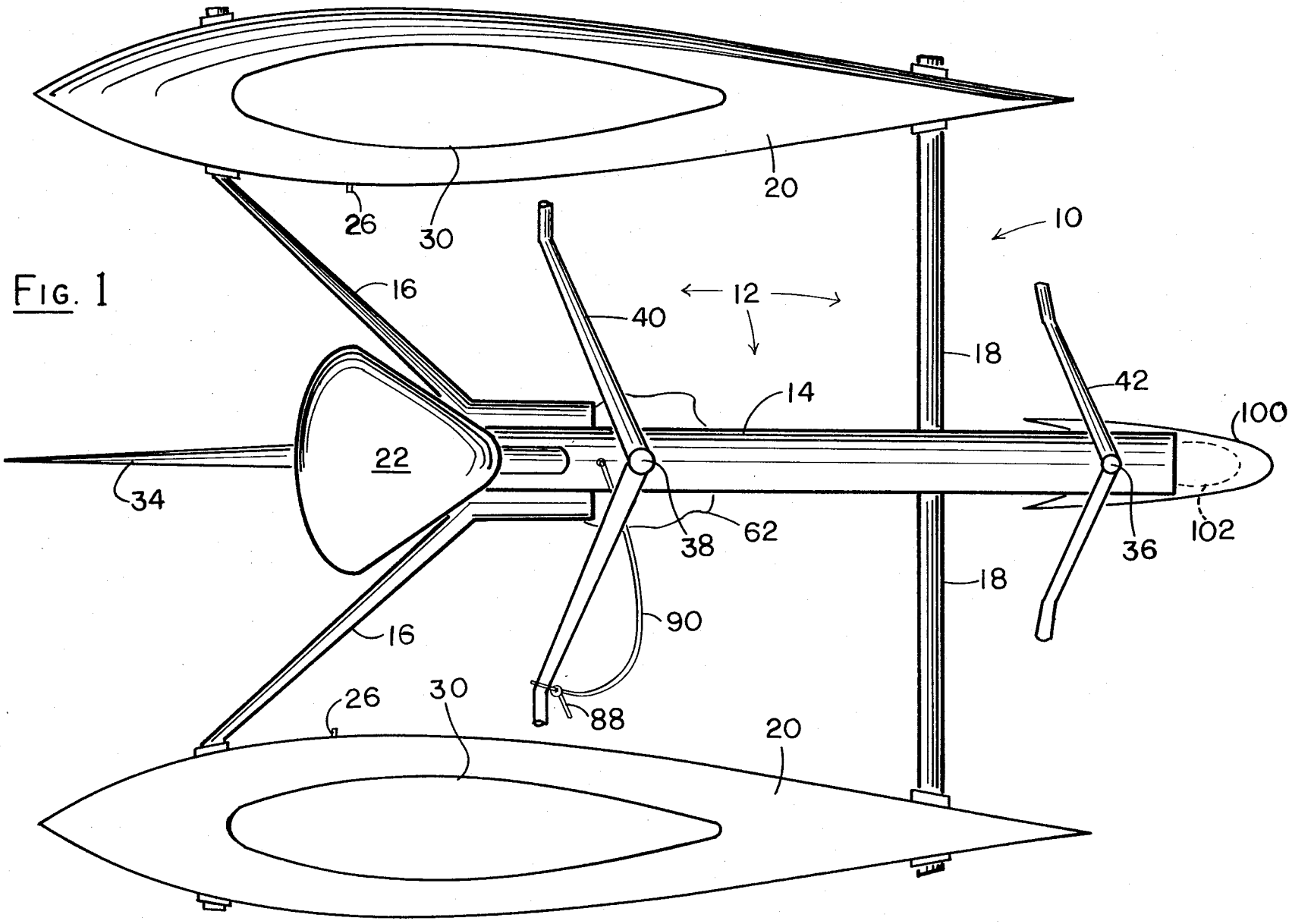
FIG. 1 is a top plan view of the sport and recreational water craft of the present invention.
Figure 2:
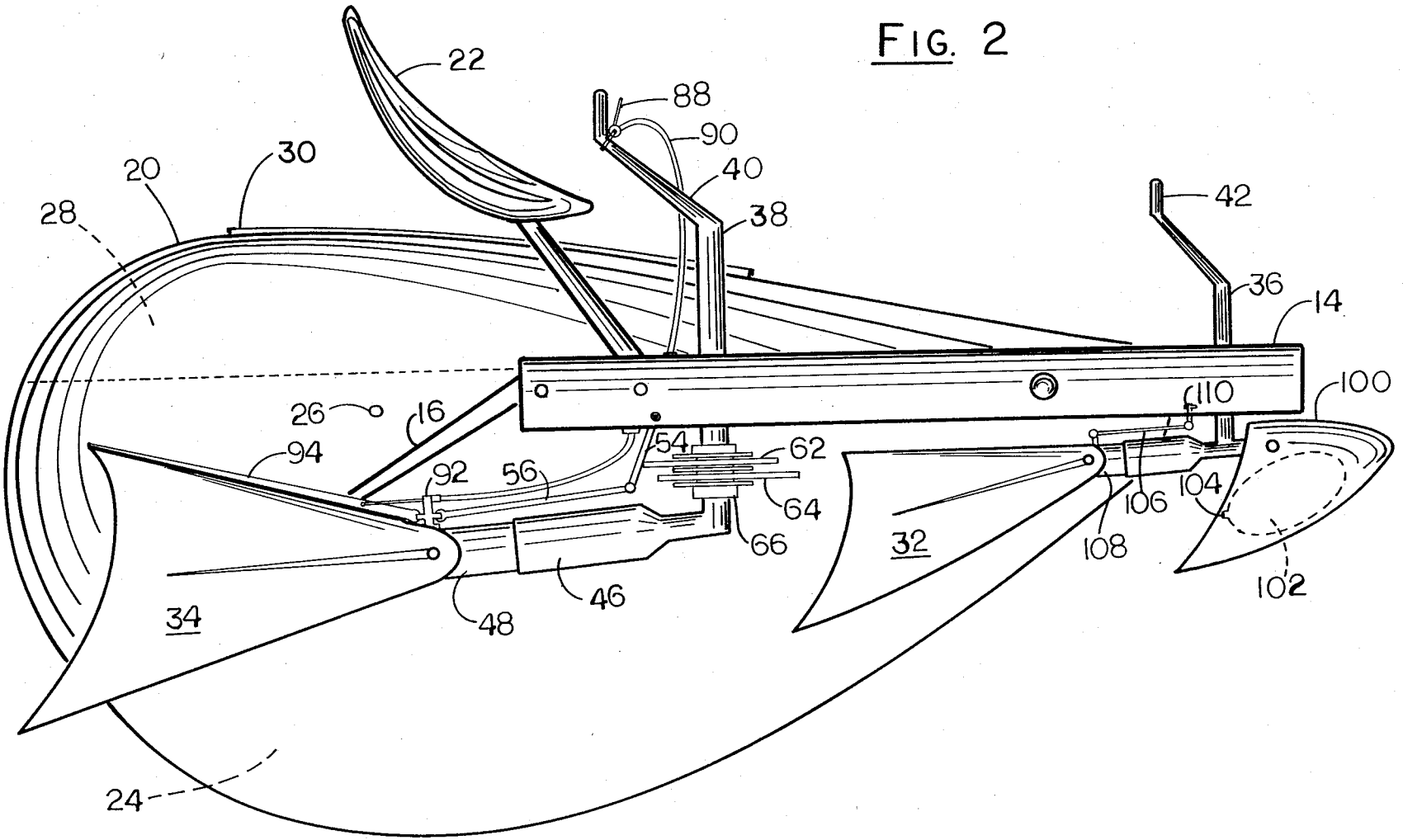
FIG. 2 is a side elevational view of the water craft of FIG. 1 with the right buoyant panel and supporting frame removed to allow viewing of the central longitudinal frame member and propulsion system in detail.

As shown in FIG. 1, the water craft 10 of the present invention includes a substantially H-shaped frame, generally designated by the reference numeral 12. Preferably, the frame 12 is fabricated of polyvinylchloride tubing that is both strong and lightweight. The frame 12 includes a central longitudinal member 14 and strut members 16, 18. The strut members 16 and 18 support a buoyant panel or pontoon 20 at each side of the frame 12 equidistant from the central member 14. The panels 20 are streamlined to allow smooth cutting action through the water (note FIGS. 1 and 2). Further, it should be appreciated that the spacing of the panels 20 on each side of the central frame member 14 provides the craft 10 with excellent balance so as to minimize side-to-side rolling in rough or choppy water.

The panels 20 are made of lightweight material providing sufficient buoyancy to float both the craft and the rider (not shown) positioned on the seat 22 over the central longitudinal frame member 14. Thus, the panels 20 may, for example, be made of an expanded synthetic resinous material such as Styrofoam (trademark) shielded with fiber coating for strength. The panels, 20, can also be formed from molded plastic sheets sealed together. Such molded panels 20 include two separate compartments. The first or lower compartment 24 is air tight and inflatable through an air valve 26 thereby allowing adjustment of the ride height of the craft 10 in the water under different loads. The second or upper compartment 28 (see FIG. 2) functions as a storage area for provisions or other items. Access to the upper compartment 28 is provided through the sealable hatch 30 at the top of the panels 20.

Craft propulsion and steering are provided by means of paddles including fore and aft fins 32, 34, respectively. As shown, the fins 32, 34 are connected to separate oscillating drive members 36, 38 extending substantially vertically through the central longitudinal frame member 14. Handles are provided at the top of each member 36, 38 for actuating the fins 32, 34. The rider, sitting on the seat 22, extends his or her legs over the substantially v-shaped handle bar 40 to engage the handle 42. The rider steers the craft by carefully modulating the positioning and movement of the fore fin 32. If the fin 32 is skewed or moved more forcefully to the starboard side of longitudinal member 14 as it is oscillated, steering is to port side; and if the fin 32 is skewed or moved more forcefully to the port side, steering is effected to the starboard side. Of course, using the same modulating technique with the aft fin 34, steering can be assisted. The aft fin is used as the main force to power the craft 10 forward through the water by engaging and oscillating the handle 42 with the hands.

Superior propulsion efficiency is provided to the craft 10 of the present invention by varying the effective length of the lever arm of the aft fin during oscillation, as has been discovered is also incorporated in the movements of an actual fish, as described above. As best shown in detail in FIG. 3, the aft fin 34 is mounted on a telescoping support forming the oscillating lever arm, as generally designated by reference numeral 44. The telescoping support 44 includes a pair of concentrically disposed tubes 46, 48 in sliding engagement. As should be appreciated, integral construction is possible with the tube 46 simply being an enlarged extension of the L-shaped drive member 38. The tubes 46, 48 are substantially elliptical in cross section (note FIG. 3*a*) so as to maintain a constant relative radial orientation with the fin 34 being maintained in a substantially vertical plane at all times. Further, some clearance is provided between the tubes 46, 48. Water enters this clearance space and lubricates the tubes 46, 48 as the tube 48 moves in and out of the tube 46 during oscillation of the fin 34 as described below.

A drive linkage, generally designated by reference numeral 50, connects the tube 48 carrying the aft fin 34 to the central longitudinal frame member 14 at a ball joint 52 aft from the drive member 38. The drive linkage 50 includes two tail fin slider rods 54, 56 pivotally connected together at the joint 58. A cam actuator 60 engages or contacts the slider rod 54 thereby providing telescopic action through the tubes 46, 48 to the aft fin 34, and thus oscillating the fin in a substantially figure eight path, as will be seen more in detail below. The rod 54 is guided in the longitudinal member 14 so as to remain in the vertical plane extending along the longitudinal axis of the member 14.

The cam actuator 60 includes a pair of cam plates 62, 64 mounted to the drive member 38 by means of a ratchet assembly 66. The upper plate 62 controls the effective length of the aft fin 34 during clockwise rotation of the drive member 38. Similarly, the lower plate 64 controls the effective length of the aft fin 34 during counterclockwise rotation of the drive member 38.

The cam plates 62, 64 are held in position between the flanges 68 of the ratchet assembly 66 for proper alignment with the sliding rod 54. A spring 70 extending between the rod 54 and the central longitudinal frame member 14 biases the rod into contact with the plates 62, 64 so as to assure proper camming action and resulting movement. Since the rod 54 is guided for vertical pivoting movement only, the entire input energy is efficiently translated through the joint 58 into driving axial thrust along the rod 56 (see FIG. 3).

Figures 3, 3A, 3B:
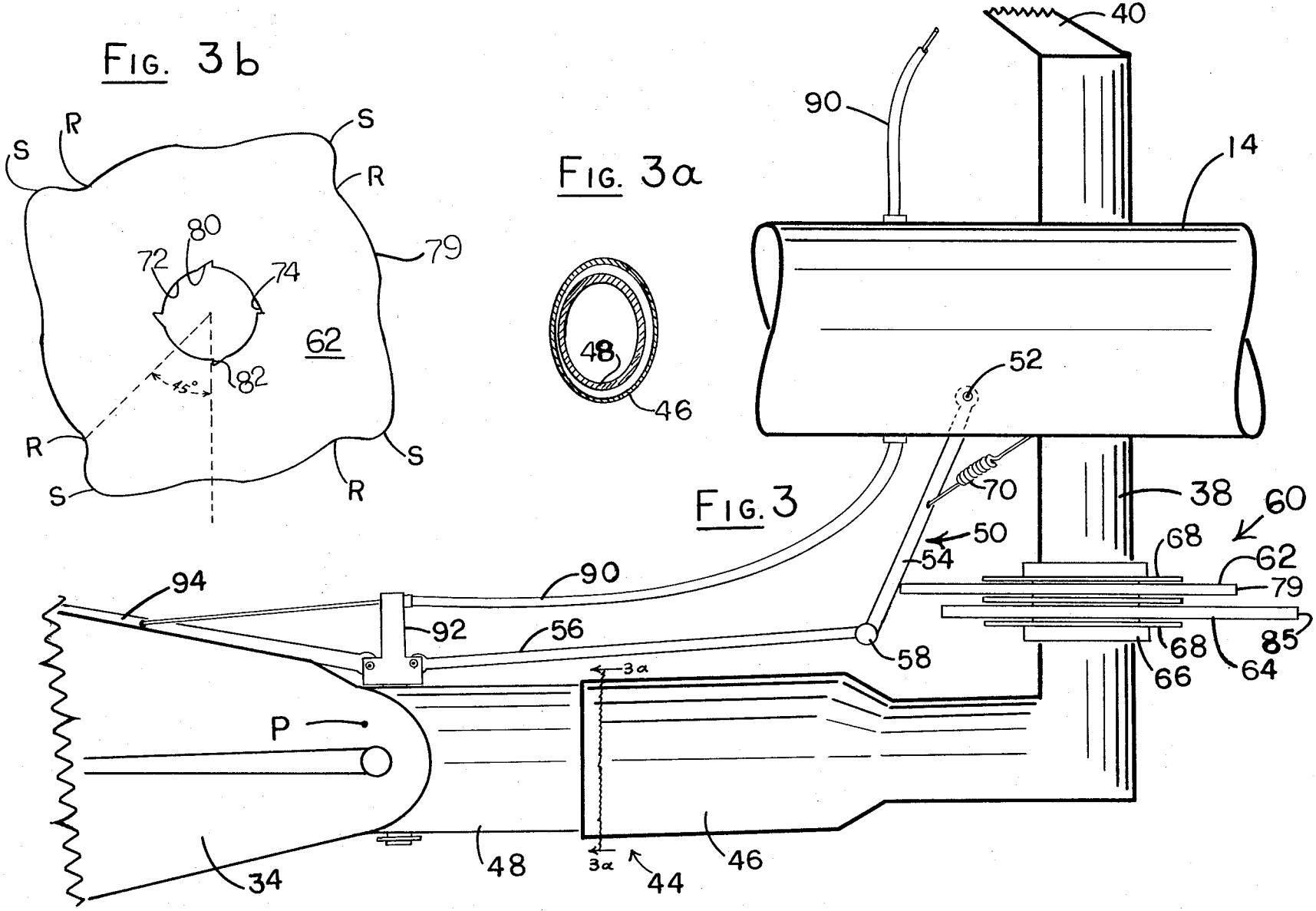
FIG. 3 is a detailed side elevational view of the telescoping support, linkage and cam actuator of the rear fin of the water craft of the present invention.
FIG. 3*a* is a cross-sectional view along line 3*a*—3*a* of FIG. 3 through the telescoping support.
FIG. 3*b* is a top plan view of one of the cam plates of the cam actuator utilized in the water craft.

Essentially, the cam plate 64 is identical to the cam plate 62 except that it is inverted through 180°. Thus, for purposes of simplification, only cam plate 62 is shown in FIG. 3B. Further, only the connection of cam plate 62 to the drive member 38 is discussed in detail below.

Figure 3D:
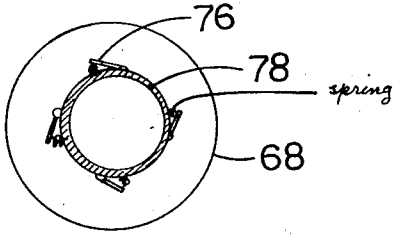
FIG. 3*d* is a cross-sectional view of the ratchet member through line 3*d*—3*d* in FIG. 3*c;*

The central aperture edge 72 of the cam plate 62 includes a series of directional notches or internal teeth 74. These notches 74 are engaged by corresponding outwardly biased pawls 76 on ratched hub 78 (see FIG. 3*d*) to provide ratcheting action. The notches 74 are circumferentially spaced every 90° on the cam plate 62. Further, it should be appreciated that when the aft fin 34 is in the middle position shown FIG. 1 (i.e. aligned with the central longitudinal frame member 14), the beginning point R of one of the four peak points S on the outer contoured cam surface 79 is in contact with the slider rod 54. Since the notches 74 are spaced at a 45° angle with respect to the points R (FIG. 3*b*), the aft fin 34 is thus advantageously designed for oscillation through a 90° arc of the drive member 38; i.e. the member 38 moves 45° in each directon from the point R (home position).

As shown, the direction notches 74 on the cam plate 62 each include: (1) a sloped ratcheting surface 80 allowing the pawls 76 to slide through the notch when the drive member 38 is rotated in the reverse (counterclockwise in FIG. 3*b*) direction; and (2) a substantially perpendicular engaging surface 82 for contacting and engaging the pawls when the drive member is rotated in the driving (clockwise) direction. Thus, the cam 62 is designed so that when the drive member 38 is rotated in the counterclockwise direction, cam plate 62 remains stationary; and conversely, when the drive member 38 is rotated in the clockwise direction, the cam plate 62 is rotated to bring larger radiused portion at point S of the contoured surface 79 into contact with the slider rod 54.

Figure 3C:
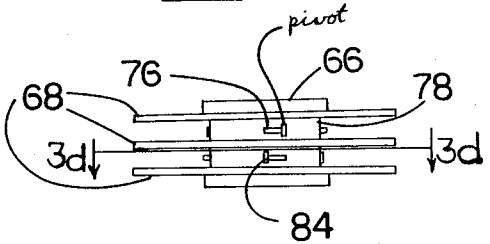
FIG. 3*c* is a side elevational view of the ratchet member for connecting the cam plates to the handle bar controlled drive member of the rear fin.

It should be appreciated that the pawls 84 and the directional notches (not shown) for the cam plate 64 extend in the opposite direction to pawls 76 (see FIG. 3*c*) and corresponding notches 74 with respect to cam plate 62. Thus, when the drive member 38 is rotated in the counterclockwise direction and the cam plate 62 is remaining stationary (or ratcheting past pawls 76) the cam plate 64 is rotating with the drive member, outer cam surface 85 contacts the slider rod 54 and the movements of the aft fin 34 are controlled. Conversely, when the drive member 38 is rotated in the clockwise direction and the plate 62 is driving the rear fin 34 plate 64 is ratcheting past pawls 84.

Figure 5:
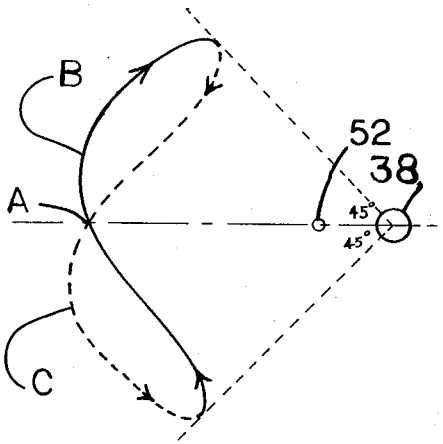
FIG. 5 is a diagrammatic representation of the increased propulsion action of the rear fin of the present invention characterised by the change in the fin length during lateral oscillation and resulting in a substantially figure eight oscillation path.

As best shown by the movement pattern in FIG. 5, the cam plates 62, 64 are each contoured to provide the desired figure eight movement to the aft fin 34 as it is oscillated through a full cycle by means of the drive member 38. In order to achieve this, the cam plates 62, 64 each control one-half of the aft fin cycle (the solid line shows control of the effective aft fin length by the cam plate 62 while the dashed line shows control of the aft fin length by the cam plate 64). Particularly, the lever arm distance from a point P on the aft fin 34 (note FIG. 3) to the pivot point of the drive member 38 is diagrammatically shown in FIG. 5. As should be appreciated, the effective length of the aft fin 34 varies during the cycle to advantageously provide additional backward force from the fin against the water, thereby increasing the forward thrust.

To further explain, starting from point A with the fin 34 aligned with the central longitudinal frame member 14, the drive member 38 is rotated in the clockwise direction. The cam plate 62 rotates with the drive member 38 through the ratchet assembly 78 contacting the slider rod 54 and extending the tube 48 and, therefore the rear fin 34 backward, against the water until point B of the cycle is reached (Point B corresponds to point 5 on the cam plate). The length of the rear fin 34 then decreases until the drive member 38 reaches its furthest clockwise rotation of substantially 45° from point A. As this occurs, the slider rod 54 under the biasing of spring 70 is held in contact with the cam plate 64, the contour of the cam plate 62 being such that it falls away from the rod.

As counterclockwise rotation of the drive member 38 is initiated, cam plate 64 contacts the slider rod 54 and initially further decreases the length of the aft fin thereby slipping the fin from the wake created during the power portion of the stroke so as to reduce drag. The cam plate 64 then begins extending the rear fin 34 backward during the power portion of the cycle to point C (note dashed line path of FIG. 5). At this point, the length of the rear fin 34 again decreases to reduce drag. Once the furthest extent of counterclockwise rotation is reached, the drive member 38 is again rotated in a clockwise direction and the cam plate 62 rotates to control the movement of the slider rod 54. After initial retraction to reduce drag, the rear 34 is extended backward to push against the water as it again passes through the point A.

It should also be appreciated that the buoyant panels 20 function like the front portion or primary body of an actual fish and, therefore, act as a counterbalance to the lever arm of the aft fin. Water resistance along the sides of the panels 20 prevent lateral drift and twisting of the craft 10 from side-to-side about the desired line of travel during aft fin 34 oscillation. Thus, the pivot point of the aft fin 34 is held fixed at the drive member 38 along the desired straight line of travel, and the working power is efficiently transferred from one end of the aft fin to the other.

Figure 4:
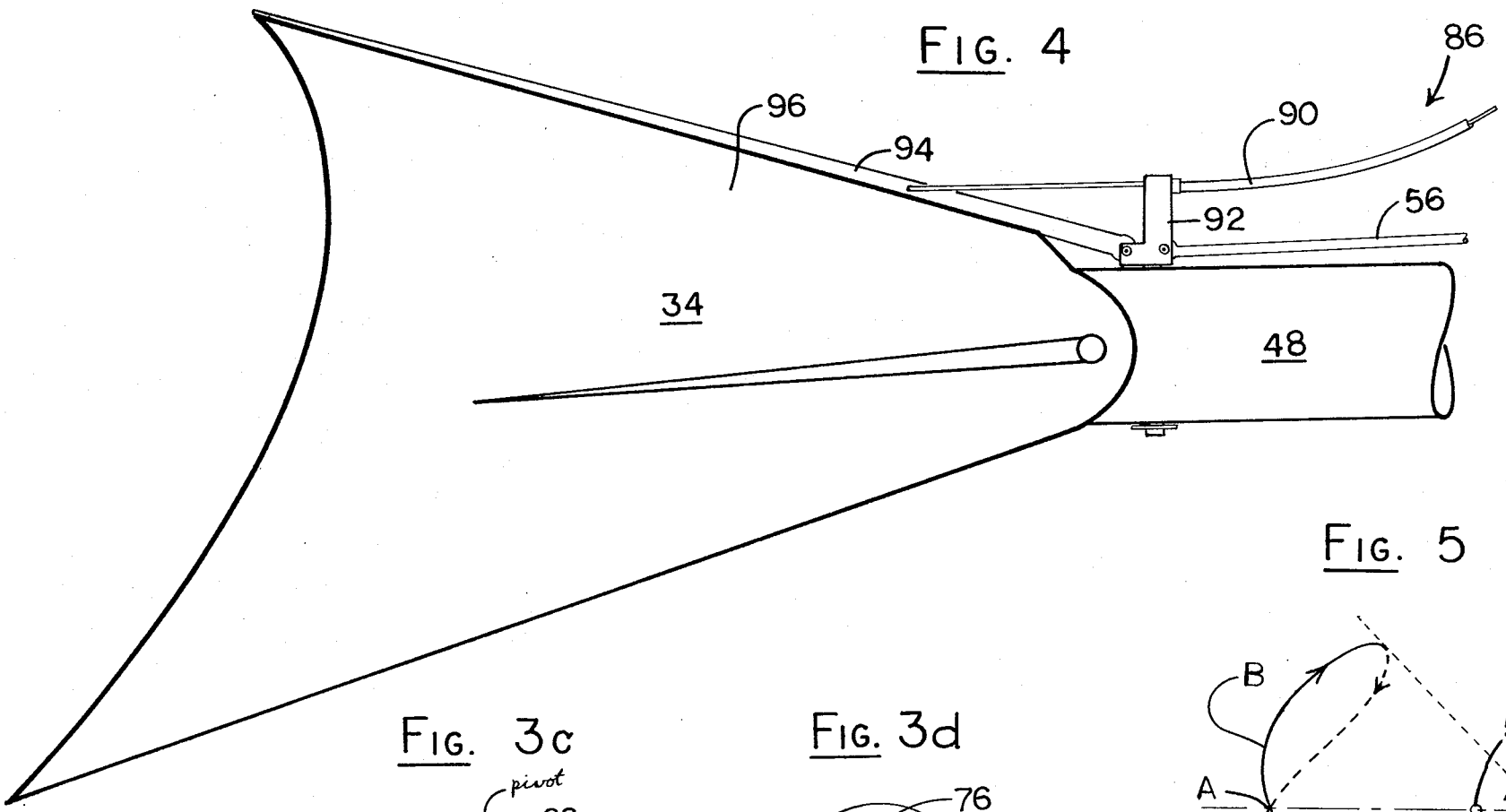
FIG. 4 is a detailed view of the rear fin showing the flexibility and rigidity control in detail.

Propulsion efficiency is further increased through the provision of a tension cable device 86 for controlling the flexibility and rigidity of the aft fin 34 (note FIG. 4). Specifically, the device includes a hand lever 88 on the handle 40 that may be easily actuated by the rider. The lever 88 is connected by a cable 90 extending through a control block 92 to a pivotally mounted cantilever arm 94. The arm 94 is connected to the top edge or margin 96 of the rear fin 34. By squeezing the lever 88, the cable 90 is drawn taut. This serves to raise the top cantilever arm 94 about its pivot point 98 and make the fin 34 more rigid, as well as increasing the span area for faster paddling.

Of course, it should also be realized that some automatic regulation of the fin flexibility and rigidity is provided within the system. As the aft fin 34 is extended during the power portions of the movement or swimming cycle, fin rigidity and span area are increased. Conversely, adjacent the limits of clockwise and counterclockwise rotation of the fin 34, the fin length is decreased; thereby reducing the rigidity and span area of the fin so as to minimize drag. It should be recognized, however, that manual control and adjustment to meet the needs of the particular rider in any situation is still possible using the hand lever 88.

Lastly, maximum performance of the water craft 10 of the present invention may require adjustment of the fore/aft flotation angle. In this regard, the water craft 10 is equipped with a front steering foil 100 connected to and controlled by the front drive member 36. A central portion of the foil may include an inflatable member 102. Air may be added or removed from the inflatable member 102 through the valve 104 so as to raise or lower the front end of the craft 10 in the water.

In summary, numerous benefits result from employing the concepts of the present invention. In particular, paddling efficiency is greatly improved through the provision of flotation panels that act as a counterbalance of the lever arm of the oscillating rear fin 34. Additionally, the aft fin 34 is not simply oscillated along a continuous arc as in the prior art. Rather, the fin is moved in a substantially figure eight path, closely imitating the natural tail movement of a fish. Thus, the fin is extended backward during the power stroke to push outward against the water and provide increased forward thrust. At the end of the power stroke, the aft fin telescoping support 44 is retracted so as to slip the fin away from the wake created during the power stroke and reduce drag. Further, it should be appreciated that the present invention allows the control of the flexibility and rigidity of the aft fin 34 both manually and automatically during fin oscillation by means of the tension cable device 86. This allows an additional increase in propulsion efficiency as described above.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, a mechanism may be provided for varying the length of the fore fin 32. As shown in FIG. 1, the mechanism includes a single rod 106 connecting the telescoping tube 108 (carrying) the fore fin 32 to the central frame member 14 at a ball joint pivot point 110 spaced from and behind the drive member 36. Thus, as the fore fin 32 is laterally oscillated, the length of the fin is gradually extended to a maximum at the central portion of the fin's arc and then again retracted as oscillation to one side continues. Such a path of oscillation is not as efficient for propulsion as the substantially figure eight path provided by the cam plates 62, 64 described in detail above. It, however, should be appreciated that the fore fin 32 does assist in propulsion in this manner. This additional mechanism clearly represents an improvement over fin mechanisms of the prior art that do not provide for any length adjustment during oscillation.

The preferred embodiment shown was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A water craft, comprising:

frame means;

flotation and balance means mounted to said frame means;

paddle means including a fore fin primarily for steering the craft and an aft fin primarily for propelling the craft, each fin being mounted to said frame means for lateral oscillation about a substantially vertical axis; and means for varying the length of said paddle means during operation so as to increase the driving force of said paddle means to said craft.

2. The water craft as recited in claim 1, wherein said frame means comprises a series of polyvinylchloride tubes in a substantially H-shape.

3. The water craft as recited in claim 1, wherein said flotation and balance means comprises a pair of spaced buoyant panels streamlined for smooth cutting action through the water.

4. The water craft as recited in claim 3, wherein said panels are foam, shielded with fiber coating for strength.

5. The water craft as recited in claim 3, wherein said panels are molded plastic sheets.

6. The water craft as recited in claim 3, wherein said panels each include two compartments, the first compartment is airtight and inflatable to be adjustable for different craft loads and the second compartment allows on-board storage.

7. The water craft as recited in claim 1, wherein a front foil is provided including an adjustable flotation means for balancing the fore/aft flotation angle of the craft in the water.

8. A water craft, comprising:

frame means;

flotation and balance means mounted to said frame means;

paddle means including a fore fin primarily for steering the craft and an aft fin primarily for propelling the craft, each fin being mounted to said frame means;

means for varying the length of said paddle means during operation so as to increase the driving force of said paddle means to said craft; and means for selectively controlling the flexibility and rigidity of said aft fin, said aft fin including a cantilever arm along an upper margin of said aft fin and said controlling means including a hand actuator and a tension cable connected to said cantilever arm.

9. The water craft as recited in claim 1, wherein said frame means includes a central longitudinal frame member, and said flotation and balance means comprises a pair of spaced flotation panels; aid central longitudinal frame member being positioned between said pair of flotation panels extending substantially parallel thereto.

10. The water craft as recited in claim 9, wherein said pair of fins is mounted on said central longitudinal frame member.

11. A water craft comprising:

frame means;

flotation and balance means mounted to said frame means;

paddle means, including at least one fin having a path of oscillation, mounted to said frame means for moving and steering said craft; and means for varying the length of said paddle means during operation so as to increase the driving force of said paddle means to said craft; said length varying means including a telescoping support for carrying said fin, a drive linkage connected between said telescoping support and said frame means, and a cam actuator for contacting said linkage and providing telescopic movement to said support, thereby oscillating said fin in a substantially figure eight path of oscillation.

12. The water craft as recited in claim 11, wherein said cam actuator and said fin are both mounted for rotation on a single drive member.

13. The water craft as recited in claim 12, wherein said telescopic support includes a pair of concentrically disposed tubes in sliding engagement, each of said tubes having a substantially elliptical cross-section to prevent relative changes in radial orientation between the tubes.

14. The water craft as recited in claim 13, wherein one of said tubes is directly connected to said aft fin and said linkage pivotally connects said tube to said frame at a point spaced from and behind said drive member.

15. The water craft as recited in claim 13, wherein clearance exists between the two tubes for water lubrication.

16. The water vehicle as recited in claim 13, wherein said cam actuator includes a pair of adjacent cam plates and ratchet means to control the operation of said cam plates; one cam plate serving to control the telescopic movement of said telescoping support when said drive member is rotated in a clockwise direction and the other cam member serving to control the telescopic movement of said telescoping support when said drive member is rotated in a counterclockwise direction.

* * * * *